US005246826A

United States Patent [19]

Herz et al.

[11] Patent Number: 5,246,826

[45] Date of Patent: Sep. 21, 1993

[54] PROCESS OF PREPARING PHOTOSENSITIVE SILVER HALIDE EMULSIONS

[75] Inventors: Arthur H. Herz; Roger L. Klaus, both of Rochester; George J. Burgmaier, Pittsford, all of N.Y.

[73] Assignee: Eastman Kodak Company, Rochester, N.Y.

[21] Appl. No.: 880,764

[22] Filed: May 8, 1992

[51] Int. Cl.[5] ..... G03C 1/005

[52] U.S. Cl. ..... 430/569; 430/567; 430/611

[58] Field of Search ..... 430/567, 569, 611

[56] References Cited

U.S. PATENT DOCUMENTS

| | | | |
|---|---|---|---|
| 3,271,157 | 9/1966 | McBride | 430/599 |
| 3,536,487 | 10/1970 | Graham | 430/611 |
| 3,574,628 | 4/1971 | Jones | 430/567 |
| 3,598,598 | 8/1971 | Herz | 430/607 |
| 4,378,424 | 3/1983 | Altland et al. | 430/611 |
| 4,631,253 | 12/1986 | Mifune et al. | 430/569 |
| 4,665,017 | 5/1987 | Mifune et al. | 430/569 |
| 4,675,276 | 6/1987 | Nakamura et al. | 430/614 |
| 4,695,534 | 9/1987 | Bryan et al. | 430/569 |
| 4,695,535 | 9/1987 | Bryan et al. | 430/569 |
| 4,713,322 | 12/1987 | Bryan et al. | 430/569 |
| 4,749,646 | 6/1988 | Herz et al. | 430/569 |
| 4,782,013 | 11/1988 | Herz et al. | 430/564 |
| 4,865,965 | 9/1989 | Friour et al. | 430/569 |
| 5,004,679 | 4/1991 | Mifune et al. | 430/569 |
| 5,028,522 | 7/1991 | Kojima et al. | 430/603 |
| 5,176,992 | 1/1993 | Maskasky et al. | 430/569 |

FOREIGN PATENT DOCUMENTS

| | | |
|---|---|---|
| 0350903 | 1/1990 | European Pat. Off. . |
| 202531/82 | 12/1982 | Japan . |
| 1586412 | 3/1981 | United Kingdom . |

*Primary Examiner*—Charles L. Bowers, Jr.
*Assistant Examiner*—Mark F. Huff
*Attorney, Agent, or Firm*—Nixon, Hargrave, Devans & Doyle

[57] ABSTRACT

The present invention relates to a process of preparing a photosensitive silver halide emulsion. In this process, an emulsion comprising an acid substituted organic ripening agent and a dispersing medium is prepared. Silver halide grains are then permitted to grow in the emulsion at a pH of from about 2 to about 4.6 to accelerate the growth of the silver halide grains. Subsequently, the pH of the emulsion is adjusted to a value of about 5.3 to about 7 to repress grain growth, to prevent interference with dye sensitization, and to limit fog formation, particularly during storage of the coated emulsion.

24 Claims, No Drawings

PROCESS OF PREPARING PHOTOSENSITIVE SILVER HALIDE EMULSIONS

FIELD OF THE INVENTION

This invention relates to photosensitive silver halide emulsions and, more particularly, to a process of preparing such emulsions.

BACKGROUND OF THE INVENTION

The preparation of photographic emulsions begins with the formulation of a dispersion of microcrystals of silver halide in a protective dispersing medium. Subsequent to or concurrent with the formation of these microcrystals, a silver halide solvent is introduced to permit dissolution, recrystallization, and growth of individual silver halide particles to a desired crystal (grain) size. This process is known as physical ripening and is typically carried out to increase the size of the silver halide crystals, because photographic sensitivity increases with increasing grain size. A wide variety of chemical substances function as solvents for silver halides; many are listed in T. H. James, ed., *The Theory of the Photographic Process*, 4th ed., Macmillan, N.Y.,1977, p. 9. Silver halide solvents are also known as Ostwald ripeners, ripening agents, crystal growth modifiers, fixing agents and growth accelerators.

In addition to enhancing silver halide crystal size, recrystallization reactions by ripening agents at apparently fixed crystal dimensions are also known to modify silver halide morphology, to alter the concentration of crystal defects, and to promote the incorporation in the silver halide crystal lattice of sensitizing species such as silver or silver sulfide clusters. These ripener-induced changes tend to increase the photographic sensitivity of silver halide emulsions, and, since all these changes involve recrystallization phenomena which also participate in silver halide growth, these phenomena are included hereafter in the discussion and claims regarding silver halide growth.

Among the substances reported to be effective ripening agents are excess halide ion and ammonia, as described in G. F. Duffin, *Photographic Emulsion Chemistry*, Focal Press Ltd., London, 1966, pp. 60–62, and thiocyanate ion, as disclosed in U.S. Pat. No. 3,320,069 to Illingsworth. Many organic compounds have also been reported to function as ripeners. For example, U.S. Pat. Nos. 3,271,157 to McBride and 3,574,628 to Jones disclose the use of thioether compounds as ripening agents for silver halide photographic materials, and U.S. Pat. No. 4,782,013 to Herz et al. discloses the use of macrocyclic ether compounds containing oxygen, sulfur, and selenium atoms for this purpose.

Silver halide solvents or ripening agents are generally ligands for $Ag^+$ ions that combine with $Ag^+$ ions to form soluble $Ag^+$ adducts or complex ions. Although ripening agents are very useful for controlling the size, dispersity, and morphology of silver halide grains and for determining the location of specific halide components in mixed silver halide compositions, they also cause problems in the emulsions during keeping or storage. Specifically, ripeners that are retained in an emulsion after formation and growth of the silver halide grains can change the rates of chemical sensitization, interfere with spectral sensitization, and promote fog formation during storage of emulsions, particularly those coated on a support.

To avoid these undesirable effects, many efforts have been made to remove organic ripeners from emulsions after formation and growth of silver halide grains by purification procedures such as washing. However, these ripening agents cannot be completely removed from emulsions even by extensive wash procedures, most likely because of their relatively low aqueous solubility and their affinity for silver halide. U.S. Pat. No. 4,665,017 to Mifune et al. proposes to circumvent this difficulty by deactivating residual ripeners through an oxidation process. This approach, however, has the disadvantage that gelatin in the emulsion also undergoes irreversible changes on oxidation. Furthermore, some ripening agents, e.g., thiourea compounds, upon oxidation yield products of increased activity with respect to desensitization and fog formation.

Another approach to countering the undesirable effect of residual silver halide solvent is the addition of emulsion stabilizers and antifoggants. However, such additives tend to interfere with spectral sensitization and can lead to loss of emulsion sensitivity.

Organic silver halide solvents or ripening agents can be classified into two types: neutral and acid-substituted. A neutral ripening agent is a compound which either is uncharged or carries an equal number of positive and negative ionic charges, i.e., a zwitterionic compound. An acid-substituted ripening agent is a compound that incorporates a covalently bonded acidic function which, upon deprotonation at about pH 7 or below, confers a negative charge on the molecule. These two classes of ripening agents are exemplified by the neutral compound ethanolamine and its acid-substituted analog, glycine. Both compounds yield $Ag^+$ complexes of similar stability and are capable of ripening AgBr emulsions. However in dilute alkaline solution, where its acidic function is deprotonated, glycine dissolves AgBr much more slowly than does the neutral ethanolamine (D. Shiao, L. Fortmiller, and A. Herz, *J. Phys. Chem.*, 1975, 79, 816).

Similarly, U.S. Pat. No. 4,749,646 to Herz et al. discloses that N,N,N',N'-tetramethylthiourea accelerates silver halide grain growth, as measured by equivalent circular diameter, more than its N,N'-dicarboxymethyl-N,N'-dimethylsubstituted analog. On the other hand, the high level of storage fog and interference with spectral sensitization of silver halide induced by tetramethylthiourea is diminished when it is replaced by its N,N'-dicarboxyethyl-N,N'-dimethyl analog.

U.S. Pat. Nos. 4,695,535 to Bryan et al. and 4,865,965 to Friour et al. also disclose acid-substituted organic ripening agents. The ripeners disclosed in U.S. Pat. No. 4,695,535 are acyclic thioether compounds containing carboxy substituents; the acid-substituted ripening agents disclosed in U.S. Pat. No. 4,865,965 are cyclic ethers.

The cited art makes it apparent that, compared with their neutral analogs, acid-substituted ripeners interfere less with dye sensitization and also cause less storage fog when coated under a conventional condition exemplified by pH values above about 4.6. However, under those conditions, the acid-substituted ripeners exist substantially in their anionic state and often suffer from the distinct disadvantage of exhibiting low activities as accelerators of silver halide growth. Hence, it is the major purpose of the present invention to overcome this barrier for the convenient application of acid-substituted ripeners in photographic systems.

SUMMARY OF THE INVENTION

The present invention relates to a process of preparing a photosensitive silver halide emulsion, such emulsions per se, and photographic elements with a support bearing such emulsions. The first step of the process involves making an emulsion containing an acid-substituted organic ripening agent and a dispersing medium. Silver halide grains are then grown in the emulsion at a pH of from about 2 to about 4.6. After the silver halide grains have grown fully, the pH of the emulsion is adjusted before coating to a value of about 5.3 to about 7 to repress further growth of the grains, to prevent interference with spectral sensitization, and to limit the storage fog of the emulsion.

This process produces silver halide emulsions with grains which have been grown to a photographically sensitive size. The activity of ripeners in such emulsions, however, has been lowered to an extent far below that present in silver halide emulsions ripened by prior art techniques. As a result, emulsions produced by the present invention do not suffer from problems with sensitivity and fog formation encountered previously. Since the presence of residual ripener in silver halide emulsions prepared by the present invention has little adverse effect, there is no reason to subject such emulsions to chemical deactivation or to a washing procedure. This constitutes a significant processing advantage over prior art procedures.

DETAILED DESCRIPTION OF THE INVENTION

The present invention relates to a method for preparing a photosensitive silver halide emulsion. Initially, an emulsion containing an acid-substituted organic ripening agent and a dispersing medium is prepared. Silver halide grains are then grown in the emulsion at a pH of about 2 to about 4.6. After a suitable level of growth is achieved, the pH of the emulsion is increased to a value of about 5.3 to about 7 to repress further growth of the grain. This step of elevating pH improves dye sensitization and limits the storage fog of the resulting silver halide emulsion.

Suitable acid-substituted organic ripeners belong to the class of ether compounds. This class includes the thioethers of previously-mentioned U.S. Pat. Nos. 3,271,157 and 3,574,628, macrocyclic ethers of previously-mentioned U.S. Pat. No. 4,782,013, selenoethers of U.S. Pat. No. 5,028,522 to Kojima et al., and thio-, seleno-, and telluro-ether compounds disclosed in U.S. Pat. No. 5,004,679 to Mifune et al., and the previously mentioned ethers of U.S. Pat. Nos. 4,695,535 to Bryan et al. and 4,865,965 to Friour et al. which are all hereby incorporated by reference. Other useful ripening agents that may be substituted with acid groups are thiols (mercaptans) and their selenium analogs, i.e. selenols, as well as cyclic and acyclic thionamides, including those of the previously mentioned U.S. Pat. No. 4,749,646 to Herz et al. and of U.S. Pat. Nos. 3,536,487 to Graham, and 3,598,598 to Herz and of British Patent Specifications 1,586,412 to Fuji. Similarly, suitable acid-substituted ripeners and silver halide solvents belonging to the class of triazolium thiolates are discussed in U.S. Pat. No. 4,378,424 to H. Altland et al.; U.S. Pat. No. 4,631,253 to H. Mifune et al.; U.S. Pat. No. 4,675,276 to K. Nakamura et al., which are all hereby incorporated by reference. The acid group of the ripening agent should have an acid dissociation constant, pKa, of about 1 to about 8, preferably about 3 to about 6.

The $Ag^+$ binding sites contained in acid-substituted organic ripening agents, or ripeners, are not particularly limited. Preferred sites are atoms in Group V of the Periodic Table, preferably nitrogen or phosphorus compounds, exemplified by amines and phosphines, and atoms in Group VI, in particular, sulfur, selenium, and tellurium. Sulfur and selenium are particularly preferred $Ag^+$ binding sites.

Particularly preferred acid-substituted organic ripening agents have the formula (I) or (II)

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent;

$R^1$, $R^2$, $R^3$, $R^4$, $R^5$, and $R^6$ each independently is a hydrocarbon or fluorocarbon group having from 1 to 6 carbon atoms, which groups are substituted or unsubstituted with one or more neutral functional groups containing heteroatoms selected from the group consisting of halogen, oxygen, sulfur, and nitrogen;

X is selected from the group consisting of S, Se, and Te;

Y is selected from the group consisting of O, S, Se, and Te;

a, b, and c are independently 0, 1, or 2, and at least one of a, b, or c is greater than zero;

m and n are independently zero or integers from 1 to 6;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$; and d, e, f, and g are independently 0 or 1, and at least one of d, e, f, and g is 1.

As previously described, an acid-substituted organic ripening agent contains a covalently bonded acidic group which, upon deprotonation at about pH 7 or below, confers a negative charge on the molecule. Such acidic substituents include —CONHOH, —OPO(OR')OH, —PO(OR')OH, —COOH, $-SO_3H$, $-SO_2H$, $-SeO_3H$, $-SeO_2H$, $-CH(CN)_2$, —SH, $-SO_2SH$, —SeH, $-SO_2SeH$, —CONHCOR', $-CONHSO_2R'$, $-SO_2NHSO_2R'$, and —CR'=NOH, where R' is H or lower alkyl or aryl.

The $R^1$, $R^2$, $R^3$, $R^4$, $R^5$, and $R^6$ substituents on the ripening agents are each independently hydrocarbon or fluorocarbon groups having from 1 to 6 carbon atoms, which groups are unsubstituted or substituted. When substituted, one or more neutral functional groups containing heteroatoms selected from the group consisting of halogen, oxygen, sulfur, and nitrogen are suitable. Particularly useful functional groups are independently selected from the group consisting of —OH, $-COR^9$, $-OR^9$, $-CONHR^9$, $-SO_2NHR^9$, and $-SO_2R^9$, wherein $R^9$ is a lower hydrocarbon group that is unsubstituted or substituted as described for $R^1$, $R^2$, $R^3$, $R^4$, $R^5$, and $R^6$. $R^1$ can be linked with $R^2$ or $R^3$ to form a cyclic group having fewer than 36 ring atoms. $R^2$ can contain one or more divalent groups or atoms selected from the group consisting of —CO—, —O—, —CONR$^8$—, —S(O)—, —S(O$_2$)—, or —SO$_2$NR$^8$—, where R$^8$ is a lower hydrocarbon group that is substituted or unsubstituted as described for R$^1$, R$^2$, R$^3$, R$^4$, R$^5$, and R$^6$. R$^4$ and R$^6$, or R$^4$ and R$^5$ can be linked to form a 5- or 6-membered ring, such as an azole, imidazolidine, thiazolidine, thiazoline, or morpholine.

Specific examples of acid-substituted organic ripeners which are useful in the present invention are set forth in Table I.

TABLE I

| Compound | Acid-Substituted Silver Halide Solvents and Ripeners<br>Structure |
|---|---|
| A1 | $H_2NCH_2COOH$ |
| A2 | 4,5-dicarboxyimidazole |
| A3 | tri(carboxyethyl)phosphine |
| A4 | m-sulfophenyldimethylphosphine |
| A5 | $Te(CH_2COOH)_2$ |
| A6 | $Te(CH_2CH_2COOH)_2$ |
| A7 | $HOCH_2CH_2TeCH_2CH_2SO_3H$ |
| A8 | $CH_2(CH_2TeCH_2CH_2CH_2TeCH_2COOH)_2$ |
| A9 | $(CH_2OCH_2CH_2SCH_2CH_2COOH)_2$ |
| A10 | $(CH_2SCH_2COOH)_2$ |
| A11 | $S(CH_2CH_2SCH_2COOH)_2$ |
| A12 | $(CH_2SCH_2CH_2SCH_2COOH)_2$ |
| A13 | $O(CH_2CH_2OCH_2CH_2SCH_2CH_2SCH_2CH_2COOH)_2$ |
| A14 | $(CH_2OCH_2CH_2SCH_2CH_2SCH_2CH_2COOH)_2$ |
| A15 | $O(CH_2CH_2SCH_2CH_2COOH)_2$ |
| A16 | 1,10-dithia-4,7,13,16-tetraoxacyclooctadecane-5-carboxylic acid |
| A17 | 1,10-dithia-4,7,13,16-tetraoxacyclooctadecane-5-methyleneoxyacetic acid |
| A18 | $[HOOC(CH_2)_3]N(CH_3)CSN(CH_3)[(CH_2)_3COOH]$ |
| A19 | 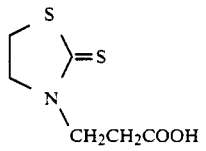 |
| A20 | 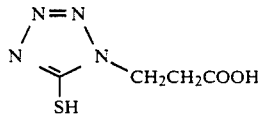 |
| A21 | 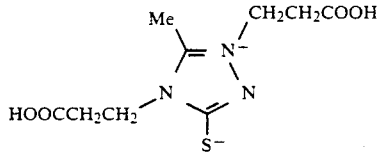 |
| A22 | 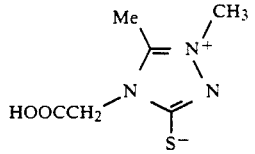 |
| A23 | 1,10-diselena-4,7,13,16-tetraoxacyclooctadecane-5-carboxylic acid |
| A24 | $(CH_2OCH_2CH_2SeCH_2CH_2COOH)_2$ |
| A25 | $(CH_2OCH_2CH_2SeCH_2CONHCH_2COOH)_2$ |
| A26 | $(CH_2CH_2—SO—CH_2CH_2SeCH_2CH_2COOH)_2$ |
| A27 | $(CH_2OCH_2CH_2SeCH_2CH_2CH_2COOH)_2$ |
| A28 | $O(CH_2CH_2CH_2SeCH_2CH_2COOH)_2$ |
| A29 | $O(CH_2CH_2CH_2SeCH_2CH_2CH_2SeCH_2CH_2COOH)_2$ |
| A30 | 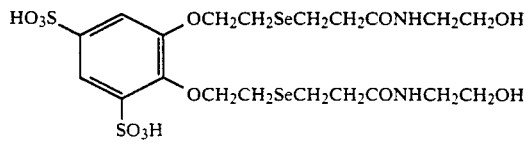 |
| A31 | 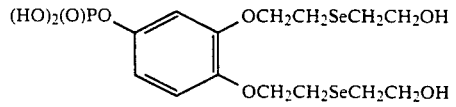 |

TABLE I-continued

| Compound | Acid-Substituted Silver Halide Solvents and Ripeners Structure |
|---|---|
| A32 | 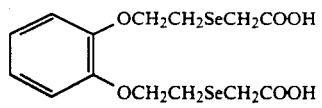 |

The method of the present invention can be used for cyclic variation and control of the activity of the acid-substituted ripener at any time during emulsion formation, growth, or sensitization of the silver halide emulsion. The acidity of the emulsion is adjusted by addition of an acid to a pH value in the range of about 2 to about 4.6, typically to pH 3, which corresponds to 1 mM free acid concentration. In this and subsequent statements on acid concentrations, it is assumed that each gram molecule of acid provides a single proton, $H^+$. At an acidity of pH 3, the growth-promoting activity of the acid-substituted ripener is near its maximum; that activity diminishes with lower acidities (increased pH) until the concentration of free acid is lowered to a concentration of approximately 0.025 mM, i.e., a value corresponding to pH 4.6. The preferred acids for providing this acidic environment are those which do not react with silver ions, for example, nitric, perchloric, sulfuric, and arenesulfonic acids. Prior to emulsion coating and storage, the acid concentration in the emulsion is further reduced to less than about 0.005 mM, that is, until the concentration of protons and hydroxide ions approximate each other or are equal, a condition which is achieved in the pH range between about 5.3 to about 7. A typical value is near pH 6. This pH adjustment reduces the activity of the ripener and stabilizes the coated emulsion against storage fog. The preferred alkalis are bases such as sodium hydroxide and tetramethylammonium hydroxide.

The specific acidity chosen to activate the acid-substituted ripener for promotion of silver halide growth in the approximate pH range between 2 and 4.6 depends on the requirements of the silver halide material and also on factors such as ripener concentration and ripener substituents, temperature, silver potential (pAg), silver halide composition, and the properties of other emulsion components such as dyes, couplers, antifoggants and the like. Similarly, the same variables apply for choosing the exact pH for ripener deactivation in the range between about pH 5.3 to about 7.

For modifying the activity and resulting sensitometric behavior of acid substituted ripeners in emulsions by acidity changes of the dispersion medium, a variety of methods besides the addition of solutions containing alkali or acid can be employed. These methods include exposure to vapors of acids or bases, the application of ion-exchange materials, or the use of compounds which decompose in the photographic composition with release of an acid or a base.

In making a silver halide emulsion in a dispersing medium containing an acid-substituted organic ripening agent, addition of these components with adjustment of acid concentration in the approximate range of 10 to 0.025 mM, corresponding to values of about pH 2 to pH 4.6, can be accomplished in a variety of ways. For example, after providing a dispersing medium, the pH of the dispersion can be adjusted to a value of about 2 to about 4.6, and the ripening agent can then be added. Alternatively, such a pH adjustment can be effected after addition of a ripening agent to the dispersing medium.

In the process of the present invention, the concentration of silver halide in the emulsion can be from $10^{-5}$ to 5 mole/liter, preferably from $10^{-3}$ to 2 mole/liter. The concentration of acid-substituted organic ripening agent can be from $10^{-6}$ to $10^{-1}$ mole/mole of silver halide, preferably from $10^{-4}$ to $10^{-2}$ mole/mole of silver halide. The silver halide grains of the emulsion can be modified at temperatures between about 30° to about 90° C., preferably between about 35° to about 70° C.

The silver halide grains grown by the process of the present invention can be silver chlorides, silver iodides or silver bromides of any crystal habit or shape, including tabular and needle forms. The silver halides can also consist of mixed halide compositions, for example, bromoiodides or chloride-rich compositions containing at least 50 mole % silver chloride. In mixed halide compositions, the various silver halides can be randomly distributed throughout the crystal or their location can be specified, for example, an emulsion having a silver chloride core and an 8 mole % silver bromide shell with a surface layer of silver iodide not exceeding 1 mole %.

The process of growing silver halide grains at a pH of about 2 to about 4.6 can be accomplished by any of the processes generally known in the art and can be achieved at any step of emulsion formation, preparation and sensitization. That process includes growth of silver halide emulsions which were formed in the absence of any ripener where, after completion of silver halide formation, the acid-substituted ripener is added to the emulsion, which optionally may contain other additives such as sensitizers of the spectral or chemical type, or growth-modifying agents such as azaindenes or thiol compounds, or a combination of organic or inorganic ripeners in addition to the acid-substituted ripeners of this invention. Also included are the art-recognized single jet and multi-jet procedures for silver halide formation; among the latter, the double jet technique is preferred.

Independent of the specific method employed for forming silver halide crystals in the photographic emulsion at a given silver potential (pAg) and temperature, the growth process with acid-substituted ripeners can be reversibly controlled by reversible changes of the dispersion's acidity. Growth is at a maximum in the pH range of about 2 to 3, diminishes with decreasing acidity in the approximate range between about pH 3 and about pH 4.6, and is increasingly inhibited at pH values above about 5.3. It is a particular advantage of this invention that since these pH changes and accompanying growth activities are reversible, this activity can be cycled by pH adjustment between acceleration and retardation and allows intermittent changes of temperature, pAg, the addition of other emulsion components like chemical sensitizers, or changes in jet stream rate or composition before eventually coating the emulsion at a pH of about 5.3 to about 7. The formation and growth of the silver halide emulsion according to this invention can be accomplished with either excess silver ions or excess halide ions but the preferred condition for growth involves 0 to about 500 mM excess halide ions, preferably between about 0.001 and 50 mM excess halide. Emulsion purification procedures before coating are optional and gelatin is the preferred colloid and vehicle for the photosensitive silver halide emulsion of the present invention. Other vehicles are disclosed in Section IX of *Research Disclosure*, Item 308119, December 1989, hereinafter referred to as *Research Disclosure*, hereby incorporated by reference.

The emulsions prepared by the method of the present invention can contain ionic antifogging agents and stabilizers such as thiols, thiazolium compounds, exemplified by benzothiazolium salts and their selenium and tellurium analogs, thiosulfonate salts, azaindenes and azoles. Also included among these antifoggants and stabilizers are compound classes which, depending on their substituents, can either be ionic or non-ionic; these classes include disulfides, diselenides and thionamides. Also specifically included are non-ionic antifoggants and stabilizers such as the hydroxycarboxylic acid derivatives of W. Humphlett in U.S. Pat. No. 3,396,028 and the polyhydroxyalkyl compounds of U.S. patent application Ser. No. 493,598 entitled "Stabilization of Photographic Recording Materials" to Lok and Herz. Other such agents are disclosed in Section VI of *Research Disclosure*, hereby incorporated by reference.

The emulsions of the present invention can contain chemical sensitizers such as those based on sulfur, selenium, silver or gold, or combinations of such sensitizers. Other sensitizing agents are disclosed in Section III of *Research Disclosure*, hereby incorporated by reference.

The photographic emulsions prepared by the method of the present invention can be spectrally sensitized with dyes such as, cyanines, merocyanines, or other dyes shown in Section IV of *Research Disclosure*, hereby incorporated by reference.

The photographic emulsions prepared by the method of the present invention can contain color image forming couplers, i.e., compounds capable of reacting with an oxidation product of a primary amine color developing agent to form a dye. They can also contain colored couplers for color correction or development inhibitor-releasing (DIR) couplers. Suitable couplers are disclosed in Section VII of *Research Disclosure*, hereby incorporated by reference.

The photographic emulsions prepared by the method of the present invention can be coated on various supports, preferably flexible polymeric films. Other supports are set forth in Section XVII of *Research Disclosure*, hereby incorporated by reference.

Emulsions prepared by the method of the present invention can be applied to a multilayer multicolor photographic material comprising a support on which is coated at least two layers having different spectral sensitivities. Such multilayer multicolor photographic materials usually contain at least one red-sensitive emulsion layer, at least one green-sensitive emulsion layer, and at least one blue-sensitive emulsion layer. The order of these layers can be optionally selected as desired. Usually a cyan-forming coupler is associated with the red-sensitive sensitive layer, a magenta-forming coupler is associated with the green-sensitive layer, and a yellow-forming coupler is associated with the blue-sensitive layer.

The photographic emulsions prepared by the method of the present invention can be processed with black and white developing agents such as hydroquinones, 3-pyrazolidones, or other compounds such as those disclosed in Section XX of *Research Disclosure*, hereby incorporated by reference. Primary aromatic amine color developing agents (e.g., 4-amino-N-ethyl-N-hydroxyethylaniline or 3-methyl-4-amino-N,N-diethylaniline) can also be employed. Other suitable color developing agents are described in L. F. A. Mason, *Photographic Processing Chemistry*, Focal Press, 1966, pp. 226–229, and in U.S. Pat. Nos. 2,193,015 and 2,592,364.

Photographic emulsions prepared by the method of the present invention can be applied to many different silver halide photographic materials such as high speed black and white films, X-ray films, and multilayer color negative films, including those having diffusion transfer applications.

As demonstrated by the following examples, the process of the present invention with acid-substituted ripeners can be used to grow silver halide grains of suitable size without promoting fog formation. The need for subsequent chemical treatment or emulsion washing to remove the ripener can, therefore, be eliminated, resulting in a shorter, more cost-effective process.

The following examples further illustrate the invention.

EXAMPLES

Example 1

Ostwald ripening rates of small-particle silver halide emulsions were determined by means of Rayleigh light scatter measurements. Details of the measurement method are given in A. L. Smith, ed., *Particle Growth in Suspensions*, Academic Press, London, 1973, pp. 159–178. At a temperature of 25° C., 8 mM AgBr emulsions having an initial diameter of about 50 nm and dispersed in 0.1% ossein gelatin (isoelectric point 4.9) containing 30 volume percent methanol and 20–28 mM $KNO_3$ in 1 mM KBr (pBr 3) were mixed, at pH values varying between 3.2 and 6.7, with varying amounts of organic ripening agents. Turbidity changes as a function of time, which correspond to AgBr growth rates, were measured at 436 nm. Growth rates were normalized with respect to rates obtained with such pH values in the absence of an organic ripener. The following results were obtained:

| Test | Ripening agent | (conc. in mM) | Emulsion pH | Relative AgBr growth rate |
|---|---|---|---|---|
| 1 | 1,10-dithia-4,7,13,16-tetraoxacyclooctadecane | (0.04) | 3.2 | 31 |
| 2 | 1,10-dithia-4,7,13,16-tetraoxacyclooctadecane | (0.04) | 5.4 | 59 |
| 3 | 1,10-dithia-4,7,13,16-tetraoxacyclooctadecane-5-carboxylic acid | (0.06) | 3.2 | 32 |
| 4 | 1,10-dithia-4,7,13,16-tetraoxacyclooctadecane-5-carboxylic acid | (0.06) | 5.4 | 4.0 |
| 5 | 1,10-dithia-4,7,13,16-tetraoxacyclooctadecane-5-methyleneoxyacetic acid | (0.06) | 3.2 | 38 |
| 6 | 1,10-dithia-4,7,13,16-tetraoxacyclooctadecane-5-methyleneoxyacetic acid | (0.06) | 5.4 | 6.0 |

-continued

| Test | Ripening agent | (conc. in mM) | Emulsion pH | Relative AgBr growth rate |
|---|---|---|---|---|
| 7 | $(CH_2OCH_2CH_2SCH_2CH_2COOH)_2$ | (0.2) | 3.3 | 23 |
| 8 | $(CH_2OCH_2CH_2SCH_2CH_2COOH)_2$ | (0.2) | 6.7 | 3.1 |
| 9 | $(CH_2OCH_2CH_2SCH_2CH_2COOH)_2$ | (0.6) | 3.3 | 320 |
| 10 | $(CH_2OCH_2CH_2SCH_2CH_2COOH)_2$ | (0.6) | 6.7 | 7.8 |

These results show that the neutral cyclic ether ripening agent of Tests 1 and 2 was about twice as active as an AgBr growth accelerator at pH 5.4 than at pH 3.2. Two structurally analogous acid-substituted ripeners on the other hand, showed greatly diminished activity at pH 5.4 compared with pH 3.2 (Tests 3 and 4,5 and 6). An acid-substituted acyclic ether ripening agent, at a concentration of 0.2 mM, showed an approximate 7-fold lowering of activity when the emulsion pH was raised from 3.3 to 6.7 (Tests 7 and 8). Increasing the concentration of this ripener to 0.6 mM resulted in an increase in relative growth rate of about 14-fold at pH 3.3 (compare Tests 7 and 9). However, raising the pH to 6.7 caused a 40-fold lowering of ripening activity (compare Tests 9 and 10). These tests demonstrate that, in accordance with the method of the present invention, adjusting the pH of a silver halide emulsion to a range of from about 2 to about 4.6 accelerated the growth of the silver halide grains, but adjustment of the emulsion pH to a range of from about 5.3 to about 7 repressed the growth of the grains.

Example 2

Tests were carried out as in Example 1, using emulsions at varying pH values between 3.0 and 6.2 and containing a 0.05 mM concentration of the acid-substituted acyclic ether ripener $(CH_2OCH_2CH_2SCH_2CH_2COOH)_2$. The following results were obtained:

| Test | Emulsion pH | Relative AgBr growth rate |
|---|---|---|
| 1 | 3.0 | 84 |
| 2 | 4.1 | 71 |
| 3 | 5.2 | 6.7 |
| 4 | 5.6 | 4.8 |
| 5 | 6.2 | 4.4 |

At pH values of about 3 or 4, the acid-substituted ripening agent produced high silver halide relative growth rates (Tests 1 and 2). Increasing the emulsion pH to about 5 or 6 achieved a large reduction (i.e., 10- to 20-fold) in ripener activity (Tests 3, 4, and 5). These results further illustrate, in accordance with the method of the present invention, the adjustment of pH to control the activity of an acid-substituted ripening agent.

Example 3

Aliquots of approximately 0.16 μm cubic AgBr emulsion were ripened for 17 hours at 25° C., at pBr 3, at pH 3, and at pH 7, in the absence and in the presence of thiourea ripening agents. The ripening reaction was quenched by the addition of N-ethyl-N'-sulfobutyl-9-methylthiacarbocyanine, and the silver halide crystal sizes were measured by electronmicrography in terms of equivalent circular diameters (ECD). The results were as follows:

| Test | Ripening agent (0.6 mM) | Emulsion pH | ECD in μm |
|---|---|---|---|
| 1 | None | 3 | 0.17 |
| 2 | None | 7 | 0.17 |
| 3 | $[(CH_3)_2N]_2C{=}S$ | 3 | 0.20 |
| 4 | " | 7 | 0.24 |
| 5 | $[HOOCCH_2CH_2CH_2N(CH_3)]_2C{=}S$ | 3 | 0.30 |
| 6 | " | 7 | 0.18 |

The ECD for a cubic AgBr emulsion containing no ripening agent was 0.17 μm at both pH 3 and 7 (Tests 1 and 2). In the presence of a neutral tetraalkyl thiourea, the ECD was 0.20 μm at pH 3 but increased to 0.24 μm when the emulsion pH was adjusted to 7 (Tests 3 and 4). An analogous acid-substituted thiourea, on the other hand, produced an ECD of 0.30 μm at pH 3, but this value dropped to 0.18 μm (essentially the same as that determined for the emulsion containing no ripener) when the pH was adjusted to 7 (Tests 5 and 6). These data further illustrate the control of activity of an acid-substituted organic ripening agent by adjustment of emulsion pH, in accordance with the present invention.

Example 4

Tests were carried out as in Example 3 at pH values of 3, 6, and 7, in the absence and in the presence of various neutral and acid-substituted organic ripening agents at several concentrations. The following results were obtained:

| Test | Ripening agent | (conc in mM) | Emulsion pH | ECD in μ |
|---|---|---|---|---|
| 1 | None | — | 3 | 0.17 |
| 2 | None | — | 6 | 0.17 |
| 3 | None | — | 7 | 0.17 |
| 4 | $(CH_2SCH_2OH)_2$ | 2.0 | 3 | 0.53 |
| 5 | " | 2.0 | 6 | 0.68 |
| 6 | 2,6-bis(hydroxy methylthiomethyl) pyridine | 2.0 | 3 | 0.25 |
| 7 | 2,6-bis(hydroxy methylthiomethyl) pyridine | 2.0 | 6 | 0.54 |
| 8 | 1,10-dithia-4,7,13, 16-tetraoxacyclooctadecane | 0.3 | 3 | 0.42 |
| 9 | 1,10-dithia-4,7,13, 16-tetraoxacyclooctadecane | 0.3 | 7 | 0.79 |
| 10 | $O(CH_2CH_2SCH_2CH_2COOH)_2$ | 0.2 | 3 | 0.41 |
| 11 | " | 0.2 | 6 | 0.18 |
| 12 | $(CH_2SCH_2CH_2SCH_2COOH)_2$ | 0.2 | 3 | 0.41 |
| 13 | " | 0.2 | 6 | 0.18 |
| 14 | $O(CH_2CH_2OCH_2CH_2SCH_2CH_2SCH_2CH_2COOH)_2$ | 0.2 | 3 | 0.66 |
| 15 | $O(CH_2CH_2OCH_2CH_2SCH_2CH_2SCH_2CH_2COOH)_2$ | 0.2 | 6 | 0.18 |

The ECD for a cubic AgBr emulsion containing no ripening agent was 0.17 μm at pH 3, 6, and 7 (Tests 1, 2, and 3). A neutral acyclic ether ripener produced an ECD of 0.53 μm at pH 3, and, when the pH was adjusted to 6, the ECD substantially increased to 0.68 μm (Tests 4 and 5). Similarly, a neutral pyridine ripener gave an ECD of 0.25 μm at a pH of 3 and an ECD of 0.54 μm when the pH was raised to 6 (Tests 6 and 7). The ECD for an emulsion containing a macrocyclic ether ripener was 0.42 μm at a pH of 3 and was 0.79 μm at a pH of 7 (Tests 8 and 9).

Distinctly different results were obtained with three acid-substituted acyclic ether ripening agents. All of them promoted the growth of the silver halide grains effectively at pH 3, producing ECD values of 0.41, 0.41, and 0.66 μm (Tests 10, 12 and 14). When the pH was adjusted to 6, however, all three ripeners exhibited low activity and achieved the same ECD of 0.18 μm. Such low ECD values are not significantly different from those obtained when the emulsion contained no ripening agent.

Example 5

Silver chloride emulsions were prepared at 68° C. by a double jet addition procedure, using ossein gelatin (isoelectric point 4.9), $AgNO_3$ solution, excess KCl solution (pAg 7.4), and 0.82 mmole/Ag mole of either a neutral or an acid-substituted acyclic ether ripening agent. A control emulsion containing no ripener was also prepared. Before initiation of AgCl formation, acidity was adjusted to either pH 3.0 or pH 5.8. After completion of the double-jet addition procedure, the pH of all the emulsions was adjusted to 5.8. The emulsions were ultrafiltered and made to conform to a weight of 0.46 kg/Ag mole.

The silver chloride crystals that were formed at pH 5.8 in the absence of a ripening agent had a mean cubic edge length (CEL) of 0.44 μm. The crystals in the emulsion that was prepared at pH 5.8 in the presence of the neutral ripener $(CH_2SCH_2OH)_2$ had a CEL of 0.63 μm. A nearly identical CEL value, 0.62 μm, was achieved in a silver chloride emulsion prepared at pH 3.0 in the presence of the acid-substituted ripening agent $(CH_2OCH_2CH_2SCH_2CH_2COOH)_2$.

Following ultrafiltration, the emulsion that had been prepared at pH 5.8 with the neutral ripening agent was analyzed by high performance liquid chromatography to determine the amount of residual ripener. It was found that 23 percent of the original amount of neutral ripening agent remained in the emulsion. Similarly, chromatographic analysis following the ultrafiltration procedure of the emulsion prepared at pH 3.0 with the acid-substituted ripening agent showed that only 2 percent of the amount of ripener originally present remained in the purified emulsion.

The emulsions that had been prepared at pH 5.8 with the neutral ripening agent and at pH 3.0 with the acid-substituted ripener were each optimally chemically sensitized at 60° C. by the addition of 5 mg/Ag mole $Au_2S$. A blue sensitizing dye, a mercaptotetrazole antifoggant, and a gelatin dispersion of a yellow dye-forming coupler were added to each emulsion. The emulsion was then coated at pH 5.8 and at a coverage of 3.4 mg Ag/dm$^2$ and 8.3 mg gelatin/dm$^2$ on a paper support. These coatings were then covered with an overcoat containing a gelatin hardener.

Following exposure to the 365 nm mercury line, the emulsion coatings were subjected to conventional color processing and sensitometric measurement. The speed for the emulsion coating prepared at pH 5.8 with the neutral ripener was determined to be 166, and 170 for the emulsion coating prepared at pH 3.0 with the acid-substituted ripener.

The coating of the emulsion prepared at pH 5.8 with the neutral ripening agent showed an initial fog of 0.06 and an increase in fog after storage for 2 weeks at 48.9° C. and 50% RH of 0.81. The coating of the emulsion prepared at pH 3.0 with the acid-substituted ripener, on the other hand, had an initial fog of 0.04, and 2 weeks of storage resulted in a fog increase of 0.58.

These data demonstrate the advantage in speed and storage fog gained by preparing silver halide grains in an emulsion having a pH of about 2 to about 4.6 and containing an acid-substituted organic ripening agent, then adjusting the pH to about 5.3 to about 7 to repress silver halide crystal growth and limit storage fog.

Example 6

A solution at 40° C. of 10 grams of ossein gelatin (isoelectric point 4.9) in 354 mL of distilled water containing 0.29 grams of the acid of substituted acyclic selenoether ripening agent $(CH_2OCH_2CH_2SeCH_2CH_2COOH)_2$ was adjusted to a pH of 3. A control solution containing no ripener was similarly prepared. The temperature was raised to 68° C., and a $AgNO_3$ solution (128 mL 5M solution in 170 mL distilled water) and a NaCl solution (37 grams in 170 mL distilled water) were added, under agitation, separately but simultaneously at a rate of 3.5 mL/min. The silver chloride emulsion prepared in the absence of a ripening agent had a mean cubic edge length (CEL) of 0.44 μm. The emulsion prepared in the presence of the acid-substituted selenoether had a CEL of 0.66 μm, demonstrating the high activity of the ripening agent at pH 3.

EXAMPLE 7

Tests were carried out as in Example 1, using emulsions at varying pH values between 3.0 and 6.1 and containing either a neutral acyclic selenoether ripening agent or a structurally analogous acid-substituted selenoether ripener, both at a concentration of 0.05 mM. Growth rates were normalized with respect to rates obtained at the given pH values in the absence of organic ripener. The results were as follows:

| Test | Ripening Agent | Emulsion pH | Relative AgBr growth rate |
|---|---|---|---|
| 1 | $(CH_2OCH_2CH_2SeCH_2CH_2CONHC_2H_5)_2$ | 3.2 | 75 |
| 2 | $(CH_2OCH_2CH_2SeCH_2CH_2CONHC_2H_5)_2$ | 5.8 | 99 |
| 3 | $(CH_2OCH_2CH_2SeCH_2CH_2CONHC_2H_5)_2$ | 6.1 | 137 |
| 4 | $(CH_2OCH_2CH_2SeCH_2CH_2COOH)_2$ | 3.0 | 77 |
| 5 | $(CH_2OCH_2CH_2SeCH_2CH_2COOH)_2$ | 4.9 | 3.8 |
| 6 | $(CH_2OCH_2CH_2SeCH_2CH_2COOH)_2$ | 5.8 | 2.1 |

The neutral selenoether ripening agent produced a high AgBr growth rate at pH 3.2 (Test 1), and that rate increased significantly as the pH was raised to 5.8 and 6.1 (Tests 2 and 3). The acid-substituted selenoether ripener exhibited very similar activity to the neutral compound at pH 3.0 (compare Test 4 with Test 1). However, the activity underwent an approximate 20-fold decrease in rate when the pH was adjusted to 4.9 (Test 5) and a further drop in rate by nearly one-half when the pH was raised to 5.8 (Test 6).

These results illustrate the control of activity of an acid-substituted acyclic selenoether ripener by adjustment of emulsion pH.

Although the invention has been described in detail for the purpose of illustration, it is understood that such detail is solely for that purpose, and variations can be made therein by those skilled in the art without departing from the spirit and scope of the invention which is defined by the following claims.

What is claim is:

1. A process for preparing a photosensitive silver halide emulsion comprising:

making an emulsion comprising silver halide at a level of $10^{-5}$ to 5 mole/liter, a dispersing medium, and an acid-substituted organic ripening agent at a level of $10^{-6}$ to $10^{-1}$ mole/mole of silver halide and having the formula (I) or (II);

$$(A)_aR^1[XR^2(A)_b]_m[YR^3(A)_c]_n \quad (I)$$

$$R^4(A)_dR^5(A)_eN-\underset{\underset{Z-R^6(A)_f}{|}}{C}=X \quad (II)$$

wherein each A is independently a covalently bonded acidic substituent; $R^1$, $R^2$, $R^3$, $R^4$, $R^5$, and $R^6$ each independently are hydrocarbon or fluorocarbon groups having from 1 to 6 carbon atoms, which groups are unsubstituted or substituted with one or more neutral functional groups containing heteroatoms selected from the group consisting of halogen, oxygen, sulfur, and nitrogen;

X is selected from the group consisting of S, Se, and Te;

Y is selected from the group consisting of O, S, Se, and Te; a, b, and c are independently 0, 1, or 2, and at least one of a, b or c is greater than zero;

m and n are independently zero or integers from 1 to 6;

Z is selected from the group consisting of O, S, Se, Te, and $-NR^7(A)_g$, wherein $R^7$ is a lower hydrocarbon group which is unsubstituted or substituted as described for $R^1$, $R^2$, $R^3$, $R^4$, $R^5$, and $R^6$; and d, e, f, and g are independently 0 or 1, and at least one of d, e, f, and g is 1;

growing silver halide grains in said emulsion at a pH of about 2 to about 4.6; and adjusting the pH of said emulsion after said growing to a value from about 5.3 to about 7 to repress further growth of said grains and to limit fog of said emulsion after being coated and stored.

2. A process according to claim 1, wherein said making comprises in sequence:

providing a dispersing medium;

adjusting the pH of said dispersing medium to a value from about 2 to about 4.6; and adding said ripening agent to said dispersing medium.

3. A process according to claim 1, wherein said making comprises in sequence:

providing a dispersing medium;

adding said ripening agent to said dispersing medium; and adjusting the pH of said dispersing medium to a value from about 2 to about 4.6.

4. A process according to claim 1, wherein said adjusting is accomplished by interrupting said growing.

5. A process according to claim 1, further comprising:

introducing at least one sensitizing agent to said emulsion.

6. A process according to claim 1, wherein the acid substituent of said ripening agent has a pKa from about 1 to about 8.

7. A process according to claim 6, wherein the acid substituent of said ripening agent has a pKa from about 3 to about 6.

8. A process according to claim 7, wherein said acidic substituents are independently selected from the group consisting of —CONHOH, —OPO(OR')OH, —PO(OR')OH, —COOH, $-SO_3H$, $-SO_2H$, $-SeO_3H$, $-SeO_2H$, $-CH(CN)_2$, —SH, $-SO_2SH$, —SeH, $-SO_2SeH$, —CONHSOR', $-CONHSO_2R'$, $-SO_2NHSO_2R'$, and —CR'=NOH, where R' is H or lower alkyl or aryl.

9. A process according to claim 8, wherein the acid substituent of said ripening agent has a pKa from about 1 to 8.

10. A process according to claim 9, wherein said acidic substituents are —COOH groups.

11. A process according to claim 1, wherein $R^1$ is linked with $R^2$ or $R^3$ to form a cyclic group having fewer than 36 ring atoms.

12. A process according to claim 1, wherein X and Y are Se.

13. A process according to claim 1 wherein m is 2 and each $R^2$ independently contains one or more divalent groups or atoms selected from the group consisting of —CO—, —O—, $-CONR^8-$, —S(O)—, $-S(O_2)-$, or $-SO_2NR^8-$, wherein $R^8$ is a lower hydrocarbon group which is unsubstituted or substituted as described for $R^1$, $R^2$, $R^3$, $R^4$, $R^5$, and $R^6$.

14. A process according to claim 1, wherein $R^4$ and $R^6$ are linked to form a 5- or 6-membered heterocyclic ring, which is unsubstituted or substituted as described for $R^1$, $R^2$, $R^3$ and $R^5$.

15. A process according to claim 14, wherein said heterocyclic ring is selected from the group consisting of an azole, imidazolidine, thiazolidine, thiazoline, and morpholine.

16. A process according to claim 1, wherein said neutral functional groups are independently selected from the group consisting of —OH, $-COR^9$, $-OR^9$, $-CONHR^9$, $-SO_2NHR^9$, and $SO_2R^9$, wherein $R^9$ is a lower hydrocarbon group which is unsubstituted or substituted as described for $R^1$, $R^2$, $R^3$, $R^4$, $R^5$, and $R^6$.

17. A process according to claim 1, wherein said ripening agent is selected from the group consisting of glycine, 4,5-dicarboxyimidazole, $Te(CH_2COOH)_2$, $(CH_2OCH_2CH_2SCH_2CH_2COOH)_2$, $(CH_2SCH_2COOH)_2$, $(CH_2SCH_2CH_2SCH_2COOH)_2$, $O(CH_2CH_2OCH_2CH_2SCH_2CH_2SCH_2CH_2COOH)_2$, $(CH_2OCH_2CH_2SCH_2CH_2SCH_2CH_2COOH)_2$, $O(CH_2CH_2SCH_2CH_2COOH)_2$, 1,10-dithia-4,7,13,16-tetraoxacyclooctadecane-5-carboxylic acid, 1,10-dithia-4,7,13,16-tetraoxacyclooctadecane methyleneoxyacetic acid, $[HOOC(CH_2)_3]N(CH_3)CSN(CH_3)[(CH_2)_3COOH]$, $(CH_2OCH_2CH_2SeCH_2CH_2COOH)_2$,

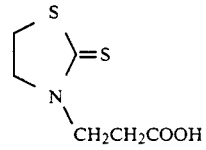

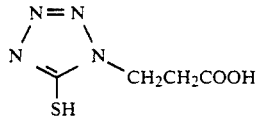

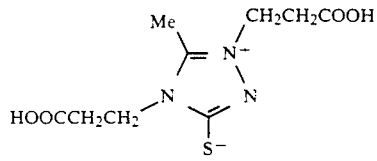

-continued

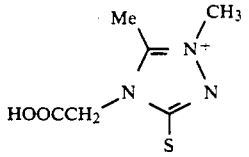

18. A process according to claim 1, wherein said silver halide is present in said emulsion at a level of $10^{-3}$ to 2 mole/liter, and said ripening agent is present in said emulsion at a level of $10^{-4}$ to $10^{-2}$ mole/mole of silver halide.

19. A process according to claim 1, wherein said silver halide is silver chlorobromoiodide.

20. A process according to claim 1, wherein said dispersing medium is peptizing gelatin.

21. An emulsion produced by the process of claim 1.

22. A photographic element with a support bearing the emulsion of claim 21.

23. An emulsion produced by the process of claim 17.

24. A photographic element with a support bearing the emulsion of claim 23.

* * * * *